US006787102B2

(12) United States Patent
Vincent

(10) Patent No.: US 6,787,102 B2
(45) **Date of Patent: *Sep. 7, 2004**

(54) NICKEL-FREE GREY GOLD ALLOY

(75) Inventor: Denis Vincent, Neuchatel (CH)

(73) Assignee: Metalor Technologies International SA, Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/054,571

(22) Filed: Nov. 12, 2001

(65) Prior Publication Data

US 2002/0127134 A1 Sep. 12, 2002

Related U.S. Application Data

(63) Continuation of application No. 09/460,471, filed on Dec. 14, 1999, now Pat. No. 6,342,182.

(30) Foreign Application Priority Data

Dec. 14, 1998 (EP) ..... 98811224

(51) Int. Cl.[7] ..... C22C 5/02
(52) U.S. Cl. ..... 420/508; 148/430
(58) Field of Search ..... 148/430; 420/508

(56) References Cited

U.S. PATENT DOCUMENTS

| | | | | | |
|---|---|---|---|---|---|
| 2,274,863 | A | | 3/1942 | Leuser | 75/165 |
| 2,980,998 | A | | 4/1961 | Coleman | 32/12 |
| 4,014,690 | A | | 3/1977 | Dudek et al. | 75/165 |
| 4,522,783 | A | | 6/1985 | Menicucci | 420/503 |
| 4,814,011 | A | * | 3/1989 | Kamohara et al. | 106/38.51 |
| 4,997,723 | A | | 3/1991 | Tanaka | 428/606 |
| 5,240,172 | A | | 8/1993 | Steinke et al. | 228/262.61 |
| 5,298,219 | A | | 3/1994 | Toyofuku et al. | 420/507 |
| 5,876,862 | A | | 3/1999 | Shibuya et al. | 428/672 |
| 5,945,065 | A | | 8/1999 | Kikuchi et al. | 420/507 |
| 6,342,182 | B1 | * | 1/2002 | Vincent | 420/508 |

FOREIGN PATENT DOCUMENTS

| | | | | | |
|---|---|---|---|---|---|
| CH | 684 616 | A | | 11/1994 | |
| GB | 2 091 294 | | | 7/1982 | |
| JP | RD 199034 | A | | 11/1980 | |
| JP | 2922227 | B | | 10/1989 | |
| JP | 09184033 | A | | 1/1996 | |
| JP | 09-078160 | A | * | 3/1997 | C22C/5/02 |
| JP | 09-184033 | A | * | 7/1997 | C22C/5/02 |

OTHER PUBLICATIONS

Patent Abstracts of Japan, vol. 97, No. 007, Jul. 31, 1997, and JP 09 078160 A (Tazaki Shinjiyu K.K.), May 25, 1997 *abrege*.

Patent Abstracts of Japan, vol. 18, No. 533 (C–1259), Jan. 11, 1994 and JP 06 184665 A (Kyocera Corp.), Jul. 5, 1994 *abrege*.

Patent Abstracts of Japan, vol. 15, No. 337 (C–862), Oct. 27, 1991 and JP 03 130333 A (Tokuriki Honten Co. Ltd.), Jun. 4, 1991 *abrege*.

Patent Abstracts of Japan, vol. 15, No. 337 (C–862), Oct. 27, 1991 and JP 03 130334 A (Tokuriki Honten Co. Ltd.), Jun. 4, 1991 *abrege*.

* cited by examiner

*Primary Examiner*—Roy King
*Assistant Examiner*—Harry D Wilkins, III
(74) *Attorney, Agent, or Firm*—Sturm & Fix LLP

(57) ABSTRACT

A nickel-free white gold alloy comprises, expressed by weight, in addition to between 75% and 76% Au and between 5% and 14% Pd, between 7% and 17% of Cu, the proportion of Cu being approximately inversely proportional to that of Pd, and the balance being formed by at least one of the elements Ir, In, Ag, Zn, Ga, Re, Zr, Nb, Si, Ta and Ti.

3 Claims, No Drawings

NICKEL-FREE GREY GOLD ALLOY

CROSS REFERENCE TO RELATED APPLICATIONS

This application is a Continuation application of U.S. patent application Ser. No. 09/460,471 filed Dec. 14, 1999, now U.S. Pat. No. 6,348,182, the disclosure of which is being incorporated herein by reference in its entirety.

BACKGROUND OF THE INVENTION

1. Field of the Invention

The present invention relates to a nickel-free grey gold alloy comprising 75–76% by weight of Au and between 5 and 14% by weight of Pd.

2. Description of the Prior Art

Problems associated with the allergy caused by nickel have led to the presence of nickel in white or grey gold alloys being reduced or even prohibited. In addition, these alloys are excessively hard and not very deformable so that they do not lend themselves well to work in particular in the fields of jeweler and watchmaking.

A nickel-free grey gold alloy having good deformability has already been proposed in CH-684,616, this alloy generally comprising, in this case, essentially between 15% and 17% by weight of Pd, between 3 and 5% of Mn and between 5 and 7% by weight of Cu. Pd is a very expensive metal, the cost of which fluctuates enormously. Lowering the proportion of Pd of the abovementioned alloy and adding Ag thereto result in a low deformability. Furthermore, too high a percentage of Ag causes the alloy to tarnish.

Moreover, JP-A-90/8160 has disclosed a ternary grey gold alloy with more than 10% by weight of Pd and more than 10% by weight of Cu, the amounts of Pd and Cu being the same, which means that the higher the Pd content the more the copper content increases, and vice versa. This amounts to saying that, for an 18 ct alloy, the respective Pd and Cu contents may only be 12.5% respectively. Furthermore, such a ternary alloy does not have the moulding properties allowing it to be used, in particular, with the so-called lost-wax technique.

SUMMARY OF THE INVENTION

The object of the present invention is to substantially improve white or grey gold alloys, allowing the proportion of Pd to be reduced without reducing its deformability properties, as well as its metallurgical properties allowing it to be used in lost-wax casting techniques.

For this purpose, the subject of this invention is a nickel-free grey gold alloy as described below.

Surprisingly, it has been found that it is possible to limit, or even reduce substantially, the proportion of Pd without impairing either the whiteness of the alloy or its metallurgical and mechanical properties, which may even be improved, by a substantial increase in the proportion of Cu. It has even been possible to show that the less Pd used the more the proportion of Cu can be increased without impairing either the colour or the desired deformability properties.

Furthermore, the incorporation of ferrous metals is also avoided so that the alloy can be used with conventional casting techniques in making jewelry and watches, as well as in the art of making dental prostheses, in which the so-called lost-wax technique is used, this being most advantageous in the case of short runs or even in the production of one-off components.

Certain other elements are added to the main elements of this alloy in order to improve its metallurgical properties, in particular to lower its melting point, to improve the grain fineness and to avoid porosity.

DETAILED DESCRIPTION OF THE INVENTION

The invention will now be described with the aid of two series of examples, a first series being more especially aimed at a proportion of Pd lying around 13% and a second series aimed at a proportion of Pd lying around 7%. As will be seen, in both cases the role of the copper is paramount. In the second case, and even if the reduction by almost half in the Pd content is partly compensated for by adding Ag and Zn, the copper content is increased by about 30% compared with the alloys of the first series.

Various other elements are incorporated in small or even very small proportions, in order to improve the properties of the alloy. Ir and Re may be added as grain refiners, and In allows the melting point to be lowered. This lowering of the melting point is a great advantage in casting using conventional moulds made of $SiO_2$ or plaster of Paris, since it prevents reaction between the components of the mould and, in particular, it prevents the production of $SO_2$ which poisons the gold alloy.

In order to improve the surface finish, it is also possible to add one of the following elements: Ti, Zr, Nb, Si and Ta, in a proportion of about 100 ppm. Although it is sought to lower the melting point of the alloy, as explained above, this is an additional safety measure.

In the examples which follow, Table I relates to the first series of alloys while Table II relates to the second series.

Apart from the composition of the alloys, given in % by weight, these tables give information relating to the hardness of the alloy in the moulded, annealed and work-hardened state, as well as the colour measured in a three-axis coordinate system. This three-dimensional measurement system is called CIELab, CIE being the acronym for Commission Internationale de l'Eclairage [*International Illumination Commission*] and Lab referring to the three coordinate axes, the L* axis measuring the black-white component (black=0; white=100), the a* axis measuring the red-green component (redness: positive a*, greenness: negative a*) and the b* axis measuring the yellow-blue component (yellowness: positive b*, blueness: negative b*). For more details on this measurement system, reference may be made to the article "The Colour of Gold-Silver-Copper Alloys" by R. M. German, M. M. Guzowski and D. C. Wright, Gold Bulletin 1980, 13, (3), pages 113–116.

Finally, these tables also indicate, in the two columns F, the melting ranges expressed in ° C. and the percentage deformability (% def).

In Table I, Examples 2, 3, 4 have a relatively low deformability, so that these alloys do not lend themselves to applications in which a high degree of deformability is required.

Examples 4, 8, 9 and 11 in this same Table I exhibit saturation in the yellow, expressed by the relatively high b* value, compared with the controls and with the other alloys of this same category, that is to say containing between 12 and 14% Pd.

With regard to Examples 2 and 6 of this same table, it may be seen that they are relatively soft after casting.

With regard to Table II, it may be seen that too high a proportion of Ag increases the b* value (saturation in the yellow). For this type of alloy, it is desirable for the b* value not to exceed 13 so that the percentage of Ag is preferably <5%.

TABLE I

| | Au | Pd | Ir | Cu | In | Re | Ga | Zn | Other | | | F | | L* | a* | b* | HV Hv cast | | HV Hv ec. | % def. |
|---|---|---|---|---|---|---|---|---|---|---|---|---|---|---|---|---|---|---|---|---|
| | % | % | % | % | % | % | % | % | % | % | | | | | | | | | | |
| 1 | 75 | 14 | 0 | 7.4 | 0 | 0 | 0 | 3.5 | 0 | 0 | | 1030 | 1098 | 81.2 | 1.8 | 7.52 | | | | |
| 2 | 75 | 14 | 0.01 | 7.4 | 3.5 | 0 | 0 | 0 | 0 | 0 | | | | 81 | 2 | 7.63 | 145 | 188 | 250 | 53 |
| 3 | 75 | 14 | 0 | 7.4 | 3.5 | 0.01 | 0 | 0 | 0 | 0.01 | Ge | 1032 | 1110 | | | | 248 | | | |
| 4 | 75 | 14 | 0.01 | 7.4 | 3.3 | 0.002 | 0.2 | 0 | 0 | 0 | | 1080 | 1130 | 81.3 | 2.26 | 9.75 | 262 | 185 | 250 | 51 |
| 5 | 75 | 13 | 0.01 | 9.4 | 2.3 | 0.002 | 0.2 | 0 | 0 | 0 | | 1028 | 1126 | 80.4 | 2.2 | 8.12 | 219 | 160 | 240 | 54 |
| 6 | 75 | 13 | 0.01 | 10.4 | 1.5 | 0.002 | 0 | 0 | 0 | 0 | | 1040 | 1115 | 80.7 | 2.16 | 7.1 | 150 | 132 | 251 | |
| 7 | 75 | 13 | 0.01 | 8.9 | 1 | 0.002 | 0 | 2 | 0 | 0 | | 1015 | 1090 | 86.8 | 2 | 8 | 183 | 145 | 274 | |
| 8 | 75 | 13 | 0.005 | 10.2 | 1.5 | 0.002 | 0.2 | 0 | 0 | 0 | | 1005 | 1110 | 79.7 | 2.29 | 8.66 | 178 | 102 | 241 | 84 |
| 9 | 75 | 13 | 0.005 | 6.3 | 2.2 | 0.002 | 0.35 | 0 | 3 | 0 | Ag | 1030 | 1145 | 81.2 | 2.1 | 8.37 | 210 | 132 | 274 | 82 |
| 10 | 75 | 13 | 0.006 | 10 | 1.5 | 0.002 | 0.35 | 0 | 0 | 0.01 | Si | 995 | 1095 | 80.9 | 2.03 | 7.51 | 200 | 145 | 230 | 80 |
| 11 | 75 | 13 | 0.006 | 10 | 1.5 | 0.002 | 0.35 | 0 | 0.032 | 0.01 | Ta, Si | 1015 | 1105 | 81.1 | 2.2 | 8.89 | 198 | 120 | 226 | 80 |
| 12 | 75 | 13 | 0.006 | 10 | 1.5 | 0.002 | 0.35 | 0 | 0.01 | 0 | Ti | 1035 | 1115 | 79.9 | 2.12 | 7.75 | 210 | 145 | 241 | 82 |
| 13 | 75 | 12 | 0.006 | 12.4 | 0 | 0.002 | 0 | 0 | 0.01 | 0 | Ti | 995 | 1090 | 79.5 | 2.14 | 8.06 | 140 | 120 | 241 | 80 |

Controls

| Au | Pd | Ir | Cu | In | Ag | Nl | Zn | Other | F | | L* | a* | b* |
|---|---|---|---|---|---|---|---|---|---|---|---|---|---|
| 75 | 13 | 0 | 7.5 | 0 | 0 | 2 | 2 | 0 | 1035 | 1100 | 82.21 | 1.43 | 7.75 |
| 75 | 13 | 0 | 7.8 | 2 | 0 | 2 | 0 | 0 | 1060 | 1105 | 83 | 1.46 | 7.75 |
| 75 | 13 | 0 | 5 | 0 | 3.3 | 1.8 | 1.8 | 0 | 1055 | 1120 | 86.65 | 1.27 | 7.88 |
| 75 | 13 | 0 | 9.5 | 0 | 0 | 2 | 0 | 0 | 1080 | 1130 | 82.96 | 1.43 | 6.99 |
| 75 | 15 | 0 | 5 | 0 | 0 | 5 | 0 | 0 | 1110 | 1155 | 82.83 | 0.96 | 6.65 |

TABLE II

| | Au | Pd | Ir | Cu | In | Ag | Re | Zn | Other | | | | F | | L* | a* | b* | HV Hv cast | | HV Hv ec. | % def. |
|---|---|---|---|---|---|---|---|---|---|---|---|---|---|---|---|---|---|---|---|---|---|
| | % | % | % | % | % | % | % | % | % | % | % | | | | | | | | | | |
| 1 | 75 | 7 | 0.01 | 12.9 | 0 | 2 | 0 | 3 | 0 | 0 | 0 | | 940 | 975 | 85.12 | 1.59 | 14.72 | 195 | 165 | 280 | |
| 2 | 75 | 6 | 0.01 | 12.9 | 0 | 2 | 0 | 4 | 0 | 0 | 0 | | 905 | 950 | 82.8 | 3.6 | 11.95 | 205 | 178 | 294 | 86 |
| 3 | 75 | 7 | 0.01 | 11.7 | 2 | 4 | 0.002 | 0 | 0 | 0 | 0.2 | Ga | 925 | 990 | 89.9 | 2.96 | 10.55 | 218 | 150 | 274 | 82 |
| 4 | 75 | 7 | 0.06 | 7.4 | 1.2 | 3 | 0.002 | 6 | 0 | 0 | 0.2 | | 845 | 940 | 81.7 | 4.14 | 12.65 | 185 | 171 | 287 | 78 |
| 5 | 75 | 7 | 0.01 | 7 | 1.2 | 7 | 0.002 | 2.5 | 2.5 | 0 | 0.2 | Ga | 915 | 990 | 85.4 | 1.79 | 15.04 | 220 | 150 | 251 | 80 |
| 6 | 75 | 7 | 0.01 | 7.5 | 1.5 | 8.7 | 0.002 | 0 | 0.012 | 0.01 | 0.2 | Ta + Si + Ga | 945 | 1030 | 84 | 2.34 | 14.18 | 191 | 117 | 241 | 80 |
| 7 | 75 | 7 | 0.01 | 11 | 0 | 0 | 0.002 | 7 | 0 | 0 | 0 | | 880 | 920 | 83.7 | 3.06 | 14.02 | 203 | 222 | 287 | 80 |
| 8 | 75 | 7 | 0.01 | 10 | 0 | 0.9 | 0.002 | 7 | 0 | 0 | 0.01 | Ti | 870 | 920 | 83.2 | 2.79 | 14.26 | 208 | 155 | 231 | 82 |
| 9 | 75 | 5 | 0.01 | 13 | 0 | 0 | 0.002 | 6.9 | 0 | 0 | 0.01 | | 870 | 900 | 85 | 2.36 | 14.27 | 248 | 178 | 268 | 80 |
| 10 | 75 | 4 | 0.01 | 16.9 | 0 | 0 | 0.002 | 4 | 0 | 0 | 0.01 | | 895 | 925 | 85.6 | 2.43 | 16.1 | 314 | 246 | 315 | 80 |
| 11 | 75 | 5 | 0.01 | 12.9 | 0 | 2 | 0.002 | 5 | 0 | 0 | 0.01 | | 875 | 915 | 85.6 | 4.43 | 15.2 | 208 | 185 | 301 | 80 |
| 12 | 75 | 6 | 0.01 | 12.9 | 0 | 2 | 0.002 | 4 | 0 | 0 | 0.01 | | 890 | 935 | 81.1 | 2.98 | 13.98 | 206 | 188 | 294 | 80 |
| 13 | 75 | 7 | 0.01 | 12.9 | 0 | 1 | 0.002 | 4 | 0 | 0 | 0.01 | | 910 | 955 | 80.6 | 3.24 | 12.19 | 210 | 188 | 274 | 80 |
| 14 | 75 | 7 | 0.01 | 13.9 | 0 | 1 | 0.002 | 3 | 0 | 0 | 0.01 | | | | 79.5 | 3.4 | 11.3 | | | | |

What is claimed is:

1. A nickel-free grey alloy to be used in lost-wax casting techniques comprising, expressed by weight Au, between 75% and 76%, Pd around 13% Cu up to a maximum of 10%, In between 1% and 2%, and Ga between 0.1 and 0.5%, the balance being formed by at least one of the elements Ir, Re, Zn, Nb, Si, Ta and Ti between 0.002 and 0.02%.

2. The alloy according to claim 1 wherein said alloy comprises, expressed by weight, Pd 13%, Cu 10%, In 1.5%, Ga 0.35%, the balance being formed by Ir, Re, and Ti.

3. The alloy according to claim 2 wherein said alloy comprises, expressed by weight, Pd 13%, Cu 10%, In 1.5%, Ga 0.35%, Ir 0.006%, Re 0.002% and Ti 0.01%.

* * * * *